US012564301B2

(12) United States Patent
Choi et al.

(10) Patent No.: US 12,564,301 B2
(45) Date of Patent: Mar. 3, 2026

(54) VACUUM CLEANER AND CONTROL METHOD FOR THE SAME

(71) Applicant: SAMSUNG ELECTRONICS CO., LTD., Suwon-si (KR)

(72) Inventors: Sanghwa Choi, Suwon-si (KR); Hyunkoo Kang, Suwon-si (KR); Seehyun Kim, Suwon-si (KR); Juhyuk Kim, Suwon-si (KR); Sanghyuk Park, Suwon-si (KR); Jinwook Yoon, Suwon-si (KR); Seongu Lee, Suwon-si (KR); Yeongju Lee, Suwon-si (KR); Jeonghee Cho, Suwon-si (KR); Jiwon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/205,851

(22) Filed: Jun. 5, 2023

(65) Prior Publication Data

US 2024/0032755 A1 Feb. 1, 2024

Related U.S. Application Data

(63) Continuation of application No. PCT/KR2023/007239, filed on May 26, 2023.

(30) Foreign Application Priority Data

Jul. 28, 2022 (KR) ..... 10-2022-0094250

(51) Int. Cl.
*A47L 9/28* (2006.01)
*A47L 5/30* (2006.01)
(Continued)

(52) U.S. Cl.
CPC ..... *A47L 9/2826* (2013.01); *A47L 5/30* (2013.01); *A47L 9/0411* (2013.01);
(Continued)

(58) Field of Classification Search
None
See application file for complete search history.

(56) References Cited

U.S. PATENT DOCUMENTS 5,255,409 A * 10/1993 Fujiwara ..... A47L 9/2831 15/412
5,381,584 A 1/1995 Jyoraku et al.
(Continued)

FOREIGN PATENT DOCUMENTS

DE 2596858 1/2022
EP 0 467 347 A1 7/1991
(Continued)

OTHER PUBLICATIONS

International Search Report dated Sep. 22, 2023 issued in PCT Application No. PCT/KR2023/007239.
(Continued)

*Primary Examiner* — Mohammad Ali
*Assistant Examiner* — Saad M Kabir
(74) *Attorney, Agent, or Firm* — STAAS & HALSEY LLP

(57) ABSTRACT

A vacuum cleaner includes a main body, a suction motor in the main body, an extension pipe, a suction head, connected to the suction motor through an extension pipe and including a suction port through which the foreign substances are sucked, a brush inside the suction head, a brush motor configured to rotate the brush, a pressure sensor configured to detect a pressure of air flowing through the suction port, a memory configured to store reference data used to identify the type of surface to be cleaned and a learning model to
(Continued)

update the reference data, and a controller configured to determine a suction pressure based on the detected pressure and an atmospheric pressure, and identify the type of surface using the determined suction pressure, a load of the brush motor, and the stored reference data, and to update the stored reference data based on a predetermined update condition.

18 Claims, 12 Drawing Sheets

(51) Int. Cl.
*A47L 9/04* (2006.01)
*A46B 13/00* (2006.01)
*A46B 13/02* (2006.01)

(52) U.S. Cl.
CPC ..... *A47L 9/0477* (2013.01); *A47L 9/2821* (2013.01); *A47L 9/2831* (2013.01); *A47L 9/2842* (2013.01); *A47L 9/2847* (2013.01); *A47L 9/2857* (2013.01); *A46B 13/006* (2013.01); *A46B 13/02* (2013.01); *A46B 2200/3033* (2013.01)

(56) References Cited

U.S. PATENT DOCUMENTS

| | | | |
|---|---|---|---|
| 9,763,551 | B2 | 9/2017 | Murchie et al. |
| 11,779,181 | B2 | 10/2023 | Jung et al. |
| 2021/0007569 | A1 | 1/2021 | Howard et al. |
| 2023/0040611 | A1* | 2/2023 | Moon ..... A47L 9/2842 |

FOREIGN PATENT DOCUMENTS

| | | | |
|---|---|---|---|
| EP | 4 434 424 | A1 | 9/2024 |
| JP | 1993-0011916 | | 7/1993 |
| JP | 5-245080 | | 9/1993 |
| JP | 5-245082 | | 9/1993 |
| JP | 2573423 | | 1/1997 |
| JP | 29923003 | | 12/1999 |
| JP | 2012-130377 | | 7/2012 |
| JP | 5830712 | | 12/2015 |
| JP | 2019-118702 | | 7/2019 |
| KR | 10-2015-0126046 | | 11/2015 |
| KR | 10-1976462 | | 8/2019 |
| KR | 10-2130691 | | 8/2020 |
| KR | 10-2023-0160159 | | 11/2023 |
| WO | WO 2021/141234 | A1 | 7/2021 |
| WO | WO 2022/008872 | A1 | 1/2022 |
| WO | WO 2023/219297 | A1 | 11/2023 |
| WO | WO 2023/224229 | A1 | 11/2023 |

OTHER PUBLICATIONS

Written Opinion Report dated Sep. 22, 2023 issued in PCT Application No. PCT/KR2023/007239.
Supplemental European Search Report dated Jul. 15, 2025 issued in European Application No. EP 23 84 6774.

* cited by examiner

FIG. 7

700

| CLEANER STATE INFORMATION | CONTROLS |
|---|---|
| Lift | OUTPUT MINIMIZATION |
| Hard floor | REFERENCE OUTPUT |
| Carpet | CONTROL TO BE GREATER THAN REFERENCE OUTPUT |
| Mat | CONTROL TO BE SMALLER THAN REFERENCE OUTPUT |

FIG. 10

1000

| UPDATE CONDITION OF HYPERPLANE DATA | |
|---|---|
| ① | IN RESPONSE TO REACHING PREDETERMINED UPDATE CYCLE |
| ② | IN RESPONSE TO DETERMINING THAT CUMULATIVE CLEANING TIME IS GREATER THAN OR EQUAL TO CRITICAL CLEANING TIME |
| ③ | IN RESPONSE TO DETERMINING THAT DIFFERENCE BETWEEN FIRST SUCTION PRESSURE CALCULATED IN LIFT STATE DURING PREVIOUS DIAGNOSIS AND SECOND SUCTION PRESSURE CALCULATED IN LIFT STATE DURING CURRENT DIAGNOSIS IS GREATER THAN OR EQUAL TO PREDETERMINED FIRST THRESHOLD VALUE |
| ④ | IN RESPONSE TO DETERMINING THAT DIFFERENCE BETWEEN FIRST LOAD OF BRUSH MOTOR DETECTED IN LIFT STATE DURING PREVIOUS DIAGNOSIS AND SECOND LOAD OF BRUSH MOTOR DETECTED IN LIFT STATE DURING CURRENT DIAGNOSIS IS GREATER THAN OR EQUAL TO PREDETERMINED SECOND THRESHOLD VALUE |
| ⑤ | IN RESPONSE TO DETERMINING THAT DISTANCE FROM COORDINATES CORRESPONDING TO DRIVING DATA OBTAINED DURING CLEANING OPERATION TO HYPERPLANE IS LESS THAN OR EQUAL TO PREDETERMINED THRESHOLD DISTANCE |

VACUUM CLEANER AND CONTROL METHOD FOR THE SAME

CROSS-REFERENCE TO RELATED APPLICATION

This application is a continuation application, under 35 U.S.C. § 111(a), of International Patent Application No. PCT/KR2023/007239, filed on May 26, 2023, which claims the priority benefit of Korean Patent Application No. 2022-0094250, filed on Jul. 28, 2022 in the Korean Intellectual Property Office, the disclosure of which is incorporated herein by reference.

BACKGROUND

1. Field

Embodiments of the present disclosure relate to a vacuum cleaner having a suction head equipped with a rotating brush and a control method for the same.

2. Description of the Related Art

A vacuum cleaner is a household appliance for cleaning places such as floors in indoor and outdoor spaces. The vacuum cleaner includes a suction motor that generates a suction force, a suction head that sucks air and foreign substances from a surface to be cleaned through the suction force of the suction motor, and a foreign substance collection chamber that separates the foreign substances from the air sucked through the suction head and collects the foreign substances. The suction head includes a housing having a suction port, and a brush for sweeping a surface to be cleaned and guiding foreign substances on the surface to be cleaned to be efficiently sucked into the suction port. The brush may be connected to a brush motor and rotatably provided. The vacuum cleaner may clean various of surfaces to be cleaned. For example, the vacuum cleaner may suck foreign substances present on a carpet, a hard floor, or a mat.

SUMMARY

Therefore, it is an aspect of the present disclosure to provide a vacuum cleaner and a control method for the same, capable of updating criteria for classifying types of surfaces to be cleaned in consideration of aging of the vacuum cleaner.

Additional aspects of the disclosure will be set forth in part in the description which follows and, in part, will be obvious from the description, or may be learned by practice of the disclosure.

A vacuum cleaner includes a main body, a suction motor in the main body and configured to generate a suction force to suck foreign substances, an extension pipe, a suction head connected to the suction motor through the extension pipe and the suction head including a suction port through which the foreign substances are sucked, a brush configured to be rotated inside the suction head, a brush motor configured to rotate the brush, a pressure sensor configured to detect a pressure of air flowing through the suction port, a memory configured to store reference data used to identify the type of surface to be cleaned and a learning model for updating the stored reference data, and a controller configured to determine a suction pressure based on the detected pressure and an atmospheric pressure, and identify the type of surface to be cleaned that is to be contacted by the suction head using the determined suction pressure, a load of the brush motor, and the stored reference data, wherein the controller is configured to update the stored reference data based on a predetermined update condition.

The controller may be configured to store suction pressure data obtained during a cleaning operation and data on the load of the brush motor as driving data in the memory, obtain the reference data and the driving data stored in the memory in response to a start of the updating, and obtain new reference data using the obtained reference data and the obtained driving data as input data of the learning model.

The reference data may include a hyperplane equation serving as a criterion to distinguish the type of surface to be cleaned in a two-dimensional coordinate system or a three-dimensional coordinate system and a support vector used to determine the hyperplane equation, and the controller may be configured to extract a new support vector based on the obtained driving data and the support vector, determine a new hyperplane equation based on the extracted new support vector, and store the extracted new support vector and the determined new hyperplane equation as the extracted new reference data.

The controller may be configured to determine the new hyperplane equation as a linear equation in the two-dimensional coordinate system in which the determined suction pressure and the load of the brush motor are variables of coordinate axes.

The driving data may further include data on a rotational speed of the brush motor, and the controller may be configured to determine the new hyperplane equation as a linear equation in the three-dimensional coordinate system in which the determined suction pressure, the load of the brush motor, and the rotational speed of the brush motor are variables of coordinate axes.

The controller may be configured to update the stored reference data according to the predetermined update condition in response to stopping operations of the suction motor and the brush motor and entering a diagnosis mode.

The controller may be configured to update the stored reference data in response to reaching a predetermined update cycle, in response to determining that a cumulative cleaning time is greater than or equal to a critical cleaning time, in response to determine that a difference between a first suction pressure calculated in a lift state during a previous diagnosis and a second suction pressure calculated in the lift state during a current diagnosis is greater than or equal to a predetermined first threshold value, determining that a difference between a first load of the brush motor detected in the lift state during the previous diagnosis and a second load of the brush motor detected in the lift state during the current diagnosis is greater than or equal to a predetermined second threshold value, or determining that a distance from coordinates corresponding to driving data obtained during a cleaning operation to a hyperplane is less than or equal to a predetermined threshold distance.

The vacuum cleaner may further include a user interface configured to obtain a user input, and the controller may be configured to enter the diagnosis mode based on whether the main body is mounted on a charging station or a diagnosis execution command is received through the user interface.

The controller may be configured to determine the load of the brush motor based on current applied to the brush motor or power consumption of the brush motor.

The controller may be configured to identify the type of surface to be cleaned based on positions of coordinates corresponding to the determined suction pressure and the load of the brush motor in a coordinate plane including a hyperplane determined by the stored reference data, and adjust at least one of an output of the suction motor or an output of the brush motor based on the identified type of surface to be cleaned.

A control method for a vacuum cleaner includes detecting a pressure of air flowing through a suction port included in a suction head in response to an operation of a suction motor, determining a suction pressure based on the detected pressure and an atmospheric pressure, determining a load of a brush motor configured to rotate a brush inside the suction head, obtaining reference data used to identify the type of surface to be cleaned from a memory, identifying the type of surface to be cleaned that contacts the suction head using the determined suction pressure, the load of the brush motor, and the reference data, adjusting at least one of an output of the suction motor or an output of the brush motor based on the identified type of surface to be cleaned, and updating the stored reference data based on a predetermined update condition.

Suction pressure data obtained during a cleaning operation and data on the load of the brush motor may be stored as driving data in the memory, and the updating of the stored reference data may include obtaining the reference data and the driving data stored in the memory in response to a start of the updating and obtaining new reference data using the obtained reference data and the obtained driving data as input data of a learning model.

The reference data may include a hyperplane equation serving as a criterion to distinguish the type of surface to be cleaned in a two-dimensional coordinate system or a three-dimensional coordinate system and a support vector used to determine the hyperplane equation, and the obtaining of the new reference data may include extracting a new support vector based on the support vector and the driving data, determining a new hyperplane equation based on the extracted new support vector, and storing the extracted new support vector and the determined new hyperplane equation as the new reference data.

The new hyperplane equation may be determined as a linear equation in the two-dimensional coordinate system in which the suction pressure and the load of the brush motor are variables of coordinate axes.

The driving data may further include data on a rotational speed of the brush motor, and the new hyperplane equation may be determined as a linear equation in the three-dimensional coordinate system in which the suction pressure, the load of the brush motor, and the rotational speed of the brush motor are variables of coordinate axes.

The updating of the stored reference data may be performed according to the predetermined update condition in response to stopping operations of the suction motor and the brush motor and entering a diagnosis mode.

The updating of the stored reference data may be performed in response to reaching a predetermined update cycle, in response to determining that a cumulative cleaning time is greater than or equal to a critical cleaning time, in response to determining that a difference between a first suction pressure calculated in a lift state during a previous diagnosis and a second suction pressure calculated in the lift state during a current diagnosis is greater than or equal to a predetermined first threshold value, in response to determining that a difference between a first load of the brush motor detected in the lift state during the previous diagnosis and a second load of the brush motor detected in the lift state during the current diagnosis is greater than or equal to a predetermined second threshold value, or in response to determining that a distance from coordinates corresponding to the driving data obtained during the cleaning operation to a hyperplane is less than or equal to a predetermined threshold distance.

The entering of the diagnosis mode may be performed based on whether the main body is mounted on a charging station or a diagnosis execution command is received through a user interface.

The load of the brush motor may be determined based on current applied to the brush motor or power consumption of the brush motor.

The identifying of the type of surface to be cleaned may include identifying the type of surface to be cleaned based on positions of coordinates corresponding to the determined suction pressure and the load of the brush motor in a coordinate plane including a hyperplane determined by the reference data.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 7 is a table for describing an example in which at least one of an output of a suction motor or an output of a brush motor is adjusted according to the type of surface to be cleaned;

FIG. 10 is a table for describing examples of update conditions for executing update of reference data;

DETAILED DESCRIPTION

Figure 1:
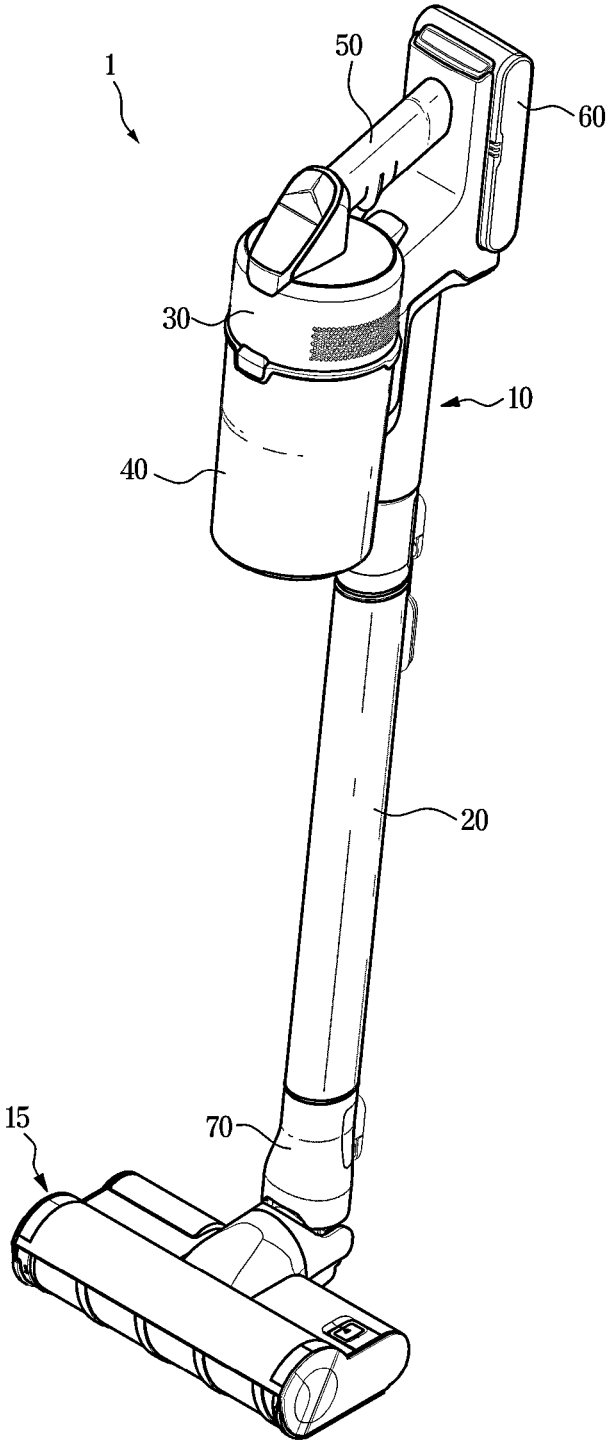
FIG. 1 shows a vacuum cleaner in accordance with one exemplary embodiment.

Exemplary embodiments described in the present specification and configurations illustrated in the drawings are just exemplary embodiments of the present disclosure, and there may be various modifications that may replace exemplary embodiments and the drawings of the present specification at the time of filing the present application.

It will be understood that when a component is referred to as being "connected" to another component throughout the present specification, it can be directly or indirectly connected to the other component. When a component is indirectly connected to another component, it may be connected to the other component through a wireless communication network.

In addition, the terms used in the present specification are merely provided to describe exemplary embodiments, and are not intended to limit or restrict the present disclosure. The singular forms, "a", "an", and "the" are intended to include the plural forms as well, unless the context clearly indicates otherwise. In the present specification, the terms "including" and/or "having", when used in the present disclosure, merely specify the presence of stated features, integers, steps, operations, elements, components, and/or groups thereof, but do not exclude in advance the possibility of the presence or addition of one or more other features, integers, steps, operations, elements, components, and/or groups thereof.

An expression "at least one of A and B" includes any of the following: A, B, A and B. The expression "at least one of A, B, and C" includes any of the following: A, B, C, A and B, A and C, B and C, A and B and C.

Terms including ordinal numbers such as first, second, etc. used in the present specification may be used to describe various elements, but it will be appreciated that the elements are not limited to such terms, and these terms are merely used to distinguish one element from another. For example, without departing from the scope of the present disclosure, a first element could be termed a second element, and similarly, a second element could be termed a first element.

In addition, the terms "portion", "device", "block", "member", and "module" used herein refer to a unit for processing at least one function or operation. For example, the terms may mean at least one process that may be processed by at least one hardware such as a field-programmable gate array (FPGA) or application specific integrated circuit (ASIC), or at least one software or processor stored in a memory.

Reference numerals used in operations are provided to identify the operations, without describing the order of the operations, and the operations can be executed in a different order from the stated order unless a specific order is definitely specified in the context.

Hereinafter, exemplary embodiments according to the present disclosure will be described in detail with reference to the accompanying drawings.

FIG. 1 shows a vacuum cleaner in accordance with one exemplary embodiment.

Referring to FIG. 1, a vacuum cleaner 1 may include a main body 10, a suction head 15, and an extension pipe 20 connecting the main body 10 and the suction head 15. The main body 10 may include a suction force generating device 30 for generating a suction force, a foreign substance collection chamber 40 for separating foreign substances from the sucked air and collecting the foreign substances, a handle 50, and a battery 60 capable of supplying electric power to the suction force generating device 30. The suction force generating device 30 may include a suction motor that converts electric power into a mechanical rotational force, and a suction fan that is connected to the suction motor and rotates.

The foreign substance collection chamber 40 may collect foreign substances through a cyclone method of separating the foreign substances using a centrifugal force or a dust bag method of separating foreign substances by passing air through a filtering bag. Air from which foreign substances are removed through the foreign substance collection chamber 40 may be discharged to the outside of the main body 10.

The extension pipe 20 may be formed of a pipe or flexible hose having a predetermined rigidity. The extension pipe 20 may transfer a suction force generated by the suction force generating device 30 to the suction head 15, and may guide air and foreign substances sucked through the suction head 15 to the main body 10. The suction head 15 may be in close contact with the surface to be cleaned to suck air and foreign substances on the surface to be cleaned. The suction head 15 may be rotatably coupled to the extension pipe 20.

Figure 2:
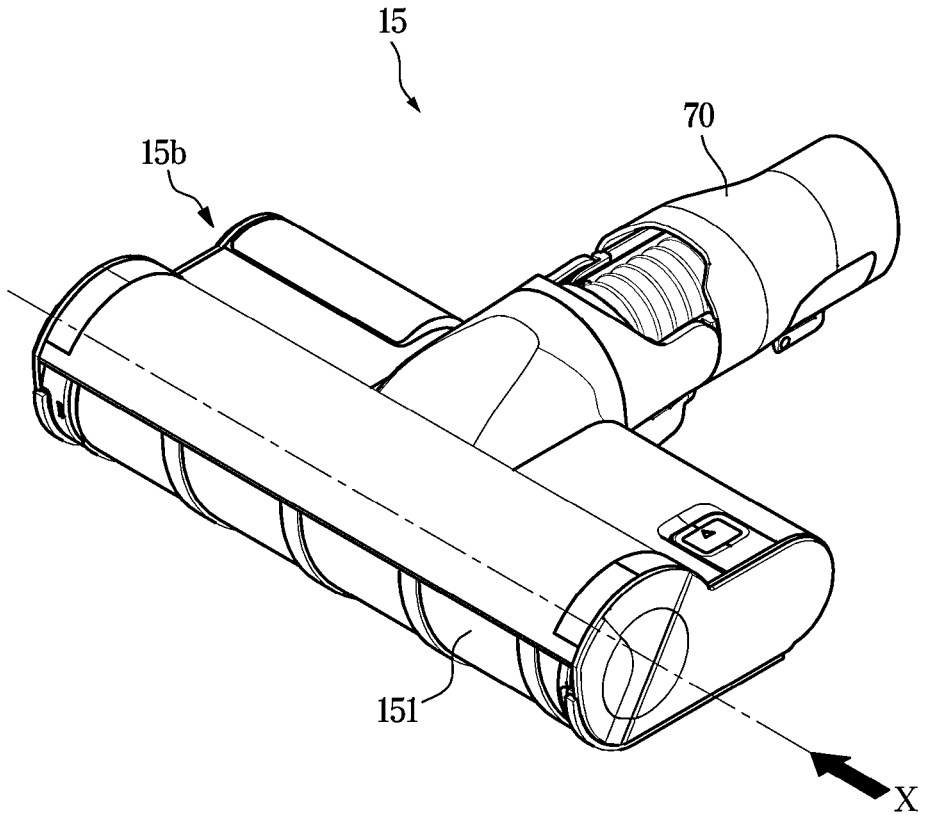
FIG. 2 shows a suction head in accordance with one exemplary embodiment.
Figure 3:
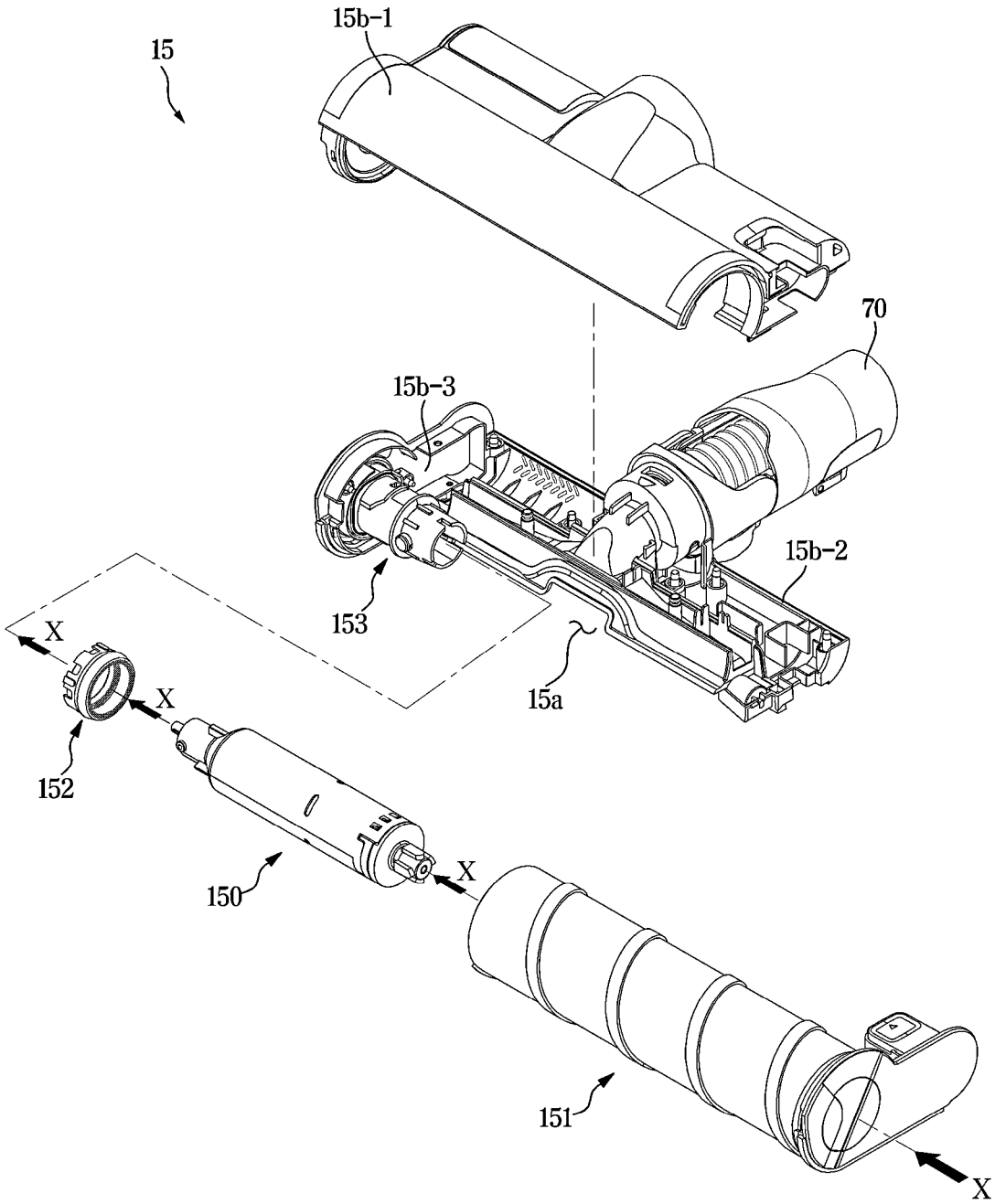
FIG. 3 is an exploded view of the suction head in accordance with one exemplary embodiment.

FIG. 2 shows the suction head 15 in accordance with one exemplary embodiment. FIG. 3 is an exploded view of the suction head 15 in accordance with one exemplary embodiment.

Referring to FIGS. 2 and 3, the suction head 15 may include a housing **15*b* in which a suction port 15*a* is formed, a brush 151 rotating so that foreign substances are effectively sucked into the housing 15*b* through the suction port 15*a*, and a suction connector 70 connecting the housing 15*b* and the extension pipe 20**.

A module coupling direction X may be defined along an axis of rotation of the brush 151. A bearing module 152, a brush motor 150, and the brush 151 may be coupled to the housing **15*b* of the suction head 15 in the module coupling direction X. For example, the housing 15*b* of the suction head 15 may be formed by assembling an upper housing 15*b*-1, a lower housing 15*b*-2, and a side housing 15*b*-3**.

The suction head 15 may include a connector module 153. The connector module 153 may be fixed to the side housing **15*b*-3. The connector module 153 may be coupled to the brush motor 150 and may supply electric power so that the brush motor 150 is driven. An electric wire (not shown) for supplying electric power, which is connected to the battery 60, may lead out from the battery 60, and may extend in the order of the main body 10, the extension pipe 20, the suction connector 70, the lower housing 15*b*-2, and the side housing 15*b*-3 and finally may be electrically connected to a connector of the connector module 153**.

The brush motor 150 may be provided in a bottle shape, for example. A case of the brush motor 150 may be provided in a bottle shape, and may be provided to enclose and protect specific components of the brush motor 150. The bottle shape may refer to a shape including a cylindrical body provided with a predetermined diameter and a neck connected to the main body and provided with a diameter smaller than the diameter of the main body.

A plug connected to the connector of the connector module 153 may be fixed to the neck of the brush motor 150. A brush driving shaft may be arranged at one end of the brush motor 150, in which the plug is arranged, and at the other end the brush motor 150 in the rotation axis direction of the brush 151. A driving force generated by the brush motor 150 may be transmitted to the brush 151 through the brush drive shaft. Therefore, the brush 151 is able to rotate.

The brush 151 may be provided in a cylindrical shape with an empty space formed along an axis of rotation (X-axis), and the brush motor 150 may be seated in the empty space formed along the axis of rotation. The connector module 153, the bearing module 152, and the brush motor 150 may be accommodated in the empty space of the brush 151. The brush 151 may rotate by the driving force transmitted from the brush motor 150. The brush 151 may scatter foreign substances present on the surface to be cleaned so that the foreign substances are efficiently sucked through the suction port **15*a***.

The suction head 15 is not limited to that described in FIGS. 2 and 3. For example, unlike the brush motor 150 that is inserted into the brush 151 and transmits power through a meshing structure, the brush motor 150 included in the suction head may be provided in such a way that power is transmitted from the outside of the brush 151 through a pulley structure. The suction head 15 may be provided in various structures including the brush 151 for increasing the suction force of foreign substances through the suction port 15*a*.

Figure 4:
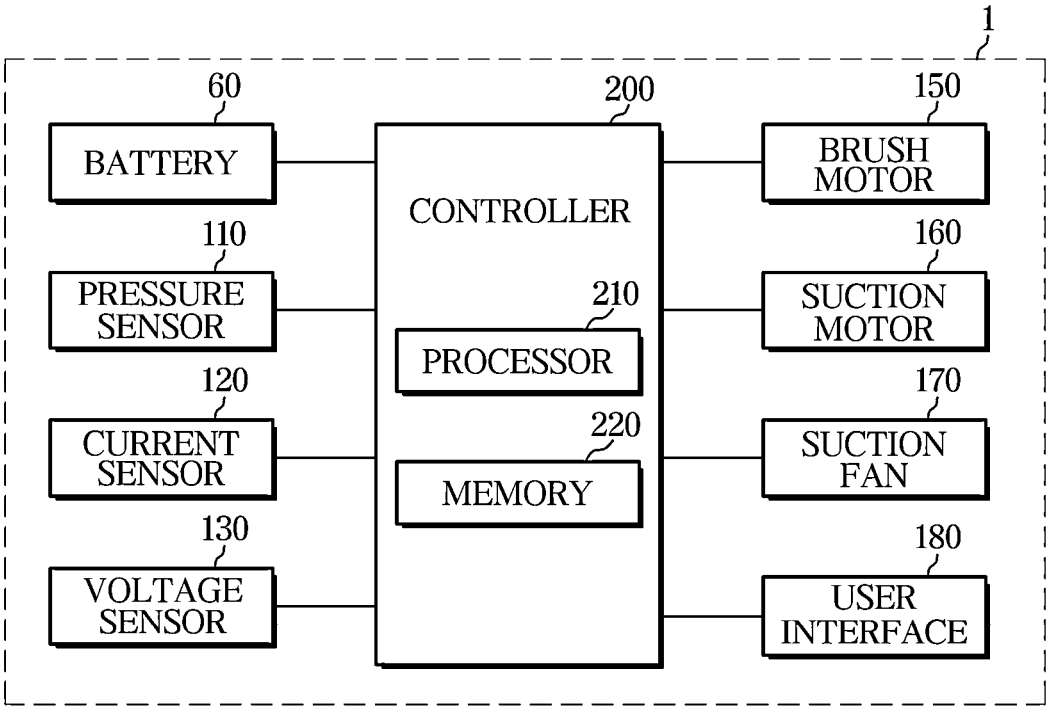
FIG. 4 is a control block diagram of the vacuum cleaner in accordance with one exemplary embodiment.

FIG. 4 is a control block diagram of the vacuum cleaner 1 in accordance with one exemplary embodiment.

Referring to FIG. 4, the vacuum cleaner 1 may include a battery 60, a pressure sensor 110, a current sensor 120, a voltage sensor 130, the brush motor 150, a suction motor 160, a suction fan 170, a user interface 180, and a controller 200. Components of the vacuum cleaner 1 are not limited to those illustrated. Some of the illustrated components may be omitted or configurations other than the illustrated components may be added. For example, the vacuum cleaner 1 may further include a communication device for communicating with an external device.

The battery 60 may supply electric power to the electronic components of the vacuum cleaner 1. For example, the battery 60 may supply electric power to the brush motor 150 and the suction motor 160. When the main body 10 is mounted on an external charging station (not shown), the battery 60 may be connected to an external power source and may be charged with electric power supplied from the external power source.

The pressure sensor 110 may detect a pressure of the suction port 15*a* provided in the suction head 15. The pressure of the suction port 15*a* may refer to a pressure of air flowing through the suction port 15*a*. In addition, the pressure sensor 110 may detect the atmospheric pressure. The pressure sensor 110 may transmit an electrical signal corresponding to the pressure of the suction port 15*a* and/or the atmospheric pressure to the controller 200.

For example, the pressure sensor 110 may include a first pressure sensor that measures the atmospheric pressure and a second pressure sensor that measures the pressure of the suction port 15*a*. The pressure sensor 110 may be a relative pressure sensor that outputs a difference between a value sensed by the first pressure sensor and a value sensed by the second pressure sensor. The position of the first pressure sensor is not limited as long as the first pressure sensor is able to measure the atmospheric pressure, and the second pressure sensor may be provided on one side of the suction port 15*a* to measure the pressure of the suction port 15*a*. In accordance with one exemplary embodiment, the second pressure sensor may be provided on one side of the extension pipe 20 or the suction connector 70 connected to the suction port 15*a*.

For another example, the pressure sensor 110 may be an absolute pressure sensor that measures the pressure of air flowing through the suction port 15*a*. The controller 200 may determine the atmospheric pressure based on a signal transmitted from the pressure sensor 110 before the suction motor 160 operates. The controller 200 may determine the pressure of the suction port 15*a* based on a signal transmitted from the pressure sensor 110 while the suction motor 160 is operating.

The controller 200 may determine the suction pressure based on the atmospheric pressure and the pressure of the suction port 15*a*. Even when the atmospheric pressure varies depending on the external environment, the controller 200 may determine an actual pressure according to foreign substances by determining the suction pressure corresponding to the difference between the atmospheric pressure and the pressure of the suction port 15*a*. In other words, the controller 200 may accurately determine the suction pressure corresponding to the actual pressure for sucking foreign substances even when the atmospheric pressure varies depending on the external environment.

The current sensor 120 may detect a current applied to the brush motor 150. For the current sensor 120, various ammeters may be provided. The voltage sensor 130 may detect a voltage applied to the brush motor 150. For the voltage sensor 130, various voltmeters may be provided. Although the current sensor 120 and the voltage sensor 130 are separately described, the current sensor 120 and the voltage sensor 130 may be provided as a single device. In addition, the current and voltage applied to the brush motor 150 may be detected by the controller 200, and in this case, the controller 200 may serve as the current sensor 120 and the voltage sensor 130.

The brush motor 150 may rotate the brush 151. The suction motor 160 may rotate the suction fan 170. With the rotation of the suction fan 170, a suction force for sucking foreign substances may be generated. The controller 200 may adjust an output of the brush motor 150. In addition, the controller 200 may adjust an output of the suction motor 160. The output of the brush motor 150 and the output of the suction motor 160 may refer to power consumptions of the respective motors.

The controller 200 may determine a load of the brush motor 150 based on the current applied to the brush motor 150. For example, when the brush motor 150 is set to maintain a constant rotational force and/or rotational speed, the current applied to the brush motor 150 may vary depending on the resistance of the surface to be cleaned. When the rotation of the brush 151 is hindered by the surface to be cleaned, the rotational force and/or rotational speed of the brush motor 150 may decrease. The controller 200 may increase the current applied to the brush motor 150 to maintain a rotational force of the brush motor 150. The controller 200 may determine that the load of the brush motor 150 increases when the current applied to the brush motor 150 increases.

In addition, the controller 200 may determine the load of the brush motor 150 based on the power consumption of the brush motor 150. The controller 200 may determine the power consumption of the brush motor 150 based on the current applied to the brush motor 150 and the voltage applied to the brush motor 150. When the current applied to the brush motor 150 increases, the power consumption of the brush motor 150 also increases. The controller 200 may determine that the load of the brush motor 150 increases when the power consumption of the brush motor 150 increases.

The user interface 180 may include a display for displaying information about a state and/or operation of the vacuum cleaner 1. The user interface 180 may include an input interface for obtaining a user input. Further, the user interface 180 may include a speaker that outputs sound.

For the display, a liquid crystal display panel (LCD panel), a light emitting diode panel (LED panel), an organic light emitting diode panel (OLED panel), or a micro-LED panel may be provided. The display may be provided as a touch display.

The input interface may include various buttons for obtaining user inputs. For example, the input interface may include a power button and an operating mode button. The controller 200 may start or stop the cleaning operation based on a user input through the power button. The controller 200 may adjust the suction force of the vacuum cleaner 1 to weak, medium, strong, or super strong based on a user input through the operating mode button. The controller 200 may adjust the output of the suction motor 160 in response to the strength of the suction force set through the operating mode button.

The controller 200 may enter a diagnosis mode based on whether the main body 10 is mounted on a charging station or a diagnosis execution command is received through the user interface 180. Operating modes of the vacuum cleaner 1 may further include the diagnosis mode. The controller 200 may enter the diagnosis mode as identifying a connection between the main body 10 and the charging station. Further, the controller 200 may enter the diagnosis mode of the vacuum cleaner 1 based on the user input through the operating mode button. When a user selects the diagnosis mode by manipulating the operating mode button, the user interface 180 may transmit a diagnosis execution command corresponding to the selection of the diagnosis mode to the controller 200.

The controller 200 may be electrically connected to components of the vacuum cleaner 1 and may control operation of the vacuum cleaner 1. The controller 200 may include a memory 220 and a processor 210. The memory 220 may store/memorize various types of information required for the operation of the vacuum cleaner 1. The memory 220 may store instructions, applications, data, and/or programs required for the operation of the vacuum cleaner 1.

The memory 220 may include volatile memory such as a static random-access memory (S-RAM) or a dynamic random-access memory (D-RAM) for temporarily storing data. In addition, the memory 220 may include a non-volatile memory such as a read only memory (ROM), an erasable programmable read only memory (EPROM), or an electrically erasable programmable read only memory (EEPROM) for long-term storage of data.

The processor 210 may generate a control signal for controlling the operation of the vacuum cleaner 1 based on the instructions, applications, data, and/or programs stored in the memory 220. The processor 210 may be hardware and include a logic circuit and an arithmetic circuit. The processor 210 may process data according to a program and/or instructions provided from the memory 220 and may generate a control signal according to a processing result. The memory 220 and the processor 210 may be implemented as one control circuit or as a plurality of circuits.

The memory 220 may store reference data used to identify the type of surface to be cleaned and a learning model for updating the reference data. The learning model may be a support vector machine (SVM) learning model. The reference data may include a hyperplane equation serving as a criterion for distinguishing the type of surface to be cleaned in a two-dimensional coordinate system or a three-dimensional coordinate system and a support vector used to determine the hyperplane equation. A hyperplane according to the hyperplane equation may be a criterion for determining the type of surface to be cleaned. The reference data may be stored in the memory 220 when the vacuum cleaner 1 is manufactured, and then the reference data may be updated according to the use of the vacuum cleaner 1.

Driving data for the vacuum cleaner 1 may include suction pressure data and data on the load of the brush motor 150. Further, the driving data may further include data on a rotational speed of the brush motor 150. The rotational speed of the brush motor 150 may refer to revolutions per minute (RPM).

The controller 200 may store driving data obtained during a cleaning operation of the vacuum cleaner 1 in the memory 220. That is, the controller 200 may store suction pressure data obtained during the cleaning operation and data on the load of the brush motor 150 as the driving data. In addition, the controller 200 may store the suction pressure data obtained during the cleaning operation, the data on the load of the brush motor 150, and the data on the rotational speed of the brush motor 150 as the driving data.

The controller 200 may determine a hyperplane using the reference data. The hyperplane may refer to a boundary line or boundary plane for dividing a plurality of pieces of driving data. One or more hyperplanes may be determined. Reference data on the hyperplane may be obtained by the learning model. When a plurality of pieces of driving data are input to the learning model, the learning model may extract support vectors and determine the hyperplane equation. Some pieces of the driving data located closest to the hyperplane among the plurality of pieces of driving data may be extracted as support vectors. That is, the support vectors may refer to data that has the greatest influence on determining the hyperplane. The SVM learning model may determine the hyperplane using only support vectors.

For example, when a variable of an x-axis is the suction pressure and a variable of a y-axis is the load of the brush motor 150, a plurality of pieces of suction pressure data and a plurality of pieces of data on the load of the brush motor 150 may be expressed as a plurality of points in the two-dimensional coordinate system. In this case, the hyperplane may be determined as a straight line on a two-dimensional coordinate plane. That is, the hyperplane equation may be determined as a linear equation in the two-dimensional coordinate system in which the suction pressure and the load of the brush motor 150 are variables of the coordinate axes. Among the plurality of points representing the plurality of pieces of suction pressure data and the plurality of pieces of data on the load of the brush motor 150, some points closest to the hyperplane may be extracted as support vectors.

In addition, when the variable of the x-axis is the suction pressure, the variable of the y-axis is the load of the brush motor 150, and the variable of the z-axis is the rotational speed of the brush motor 150, the plurality of pieces of suction pressure data, the plurality of pieces of data on the load of the brush motor 150, and the plurality of pieces of data on the rotational speed of the brush motor 150 may be expressed as a plurality of points in a three-dimensional coordinate space. In this case, the hyperplane may be determined as a plane in the three-dimensional coordinate space. The hyperplane equation may be determined as a linear equation in the three-dimensional coordinate system in which the suction pressure, the load of the brush motor 150, and the rotational speed of the brush motor 150 are variables of the coordinate axes. Among the plurality of points representing the plurality of pieces of suction pressure data, the plurality of pieces of data on the load, and the plurality of pieces of data on the rotational speed, some points closest to the hyperplane may be extracted as support vectors.

The controller 200 may identify the type of surface to be cleaned that contacts the suction head 15 using the suction pressure, the load of the brush motor 150, and the reference data. For example, the controller 200 may identify the type of surface to be cleaned based on positions of coordinates corresponding to a suction pressure obtained during the cleaning operation of the vacuum cleaner 1 and the load of the brush motor 150, in a coordinate plane including a hyperplane determined by the reference data. In addition, the controller 200 may identify the type of surface to be cleaned based on positions of coordinates corresponding to the suction pressure obtained during the cleaning operation, the load of the brush motor 150, and the rotational speed of the brush motor 150, in the coordinate space including the hyperplane.

The controller 200 may adjust at least one of the output of the suction motor 160 or the output of the brush motor 150 based on the identified type of surface to be cleaned. For example, the controller 200 may adjust at least one of the output of the suction motor 160 or the output of the brush motor 150 as a reference output based on the identifying of the surface to be cleaned as a hard floor. Based on the identifying of the surface to be cleaned as a carpet, the controller 200 may adjust at least one of the output of the suction motor 160 or the output of the brush motor 150 to be greater than the reference output. Based on the identifying of the surface to be cleaned as a mat, the controller 200 may adjust at least one of the output of the suction motor 160 or the output of the brush motor 150 to be smaller than the reference output. In addition, the controller 200 may minimize the output of the brush motor 150 and the output of the suction motor 160 based on identifying a state in which the suction head 15 is positioned in the air, that is, a lift state.

As described above, the vacuum cleaner 1 may increase a use time of the battery 60 and improve cleaning performance by adjusting at least one of the output of the brush motor 150 or the output of the suction motor 160 according to the type of surface to be cleaned.

Meanwhile, as a cumulative use time of the vacuum cleaner 1 increases, the vacuum cleaner 1 may age. Due to the aging of the vacuum cleaner 1, the performance of devices such as the battery 60, the brush motor 150, and the suction motor 160 may be changed. For example, when a new vacuum cleaner 1 and an aging vacuum cleaner 1 are compared, the new vacuum cleaner 1 and the aging vacuum cleaner 1 may be different in the suction pressure detected while cleaning the same surface to be cleaned and in the load of the brush motor 150. When the reference data stored at the time of manufacture of the vacuum cleaner 1 is used as it is in the aging vacuum cleaner 1, the change in the suction pressure and the change in the load of the brush motor 150 may not be reflected, causing a problem that the type of surface to be cleaned is incorrectly identified. In this case, the erroneous identification may cause consumers to misunderstand product failure and may adversely affect the cleaning performance and the battery performance. The disclosed vacuum cleaner 1 is able to solve the problems by updating the reference data in consideration of aging.

The controller 200 may update the reference data stored in the memory 220 based on a predetermined update condition. The reference data may be updated by the learning model. When the reference data stored in the memory 220 and the plurality of pieces of driving data obtained during the cleaning operation are input to the learning model, the learning model may output new reference data.

The controller 200 may update the reference data based on the predetermined update condition after operations of the suction motor 160 and the brush motor 150 are stopped. For example, updating of the reference data may be performed in the diagnosis mode. The controller 200 may determine whether to update the reference data according to the predetermined update condition in response to stopping the operations of the suction motor 160 and the brush motor 150 and entering the diagnosis mode.

For example, the controller 200 may update the reference data when any one of five update conditions illustrated below is met. 1) when a predetermined update cycle is reached, 2) when a cumulative cleaning time is greater than or equal to a critical cleaning time, 3) when a difference between a first suction pressure calculated in a lift state during a previous diagnosis and a second suction pressure calculated in the lift state during a current diagnosis is greater than or equal to a predetermined first threshold value, 4) when a difference between a first load of the brush motor 150 detected in the lift state during the previous diagnosis and a second load of the brush motor 150 detected in the lift state during the current diagnosis is greater than or equal to a predetermined second threshold value, or 5) when a distance from coordinates corresponding to the driving data obtained during the cleaning operation to the hyperplane is less than or equal to a predetermined threshold distance.

The controller 200 may obtain the reference data and driving data stored in the memory 220 in response to the start of update, and obtain new reference data using the reference data and driving data as input data of the learning model. Specifically, the controller 200 may extract a new support vector based on the support vector of the reference data and the driving data, and may determine a new hyperplane equation based on the new support vector. That is, coefficients and constants of the hyperplane equation may be changed to new values. The controller 200 may store the new support vector and the new hyperplane equation in the memory 220 as new reference data.

The controller 200 may determine the new hyperplane equation as a linear equation in the two-dimensional coordinate system in which the suction pressure and the load of the brush motor 150 are variables of the coordinate axes. In addition, the controller 200 may determine the new hyperplane equation as a linear equation in the three-dimensional coordinate system in which the suction pressure, the load of the brush motor 150, and the rotational speed of the brush motor 150 are variables of the coordinate axes.

Figure 5:
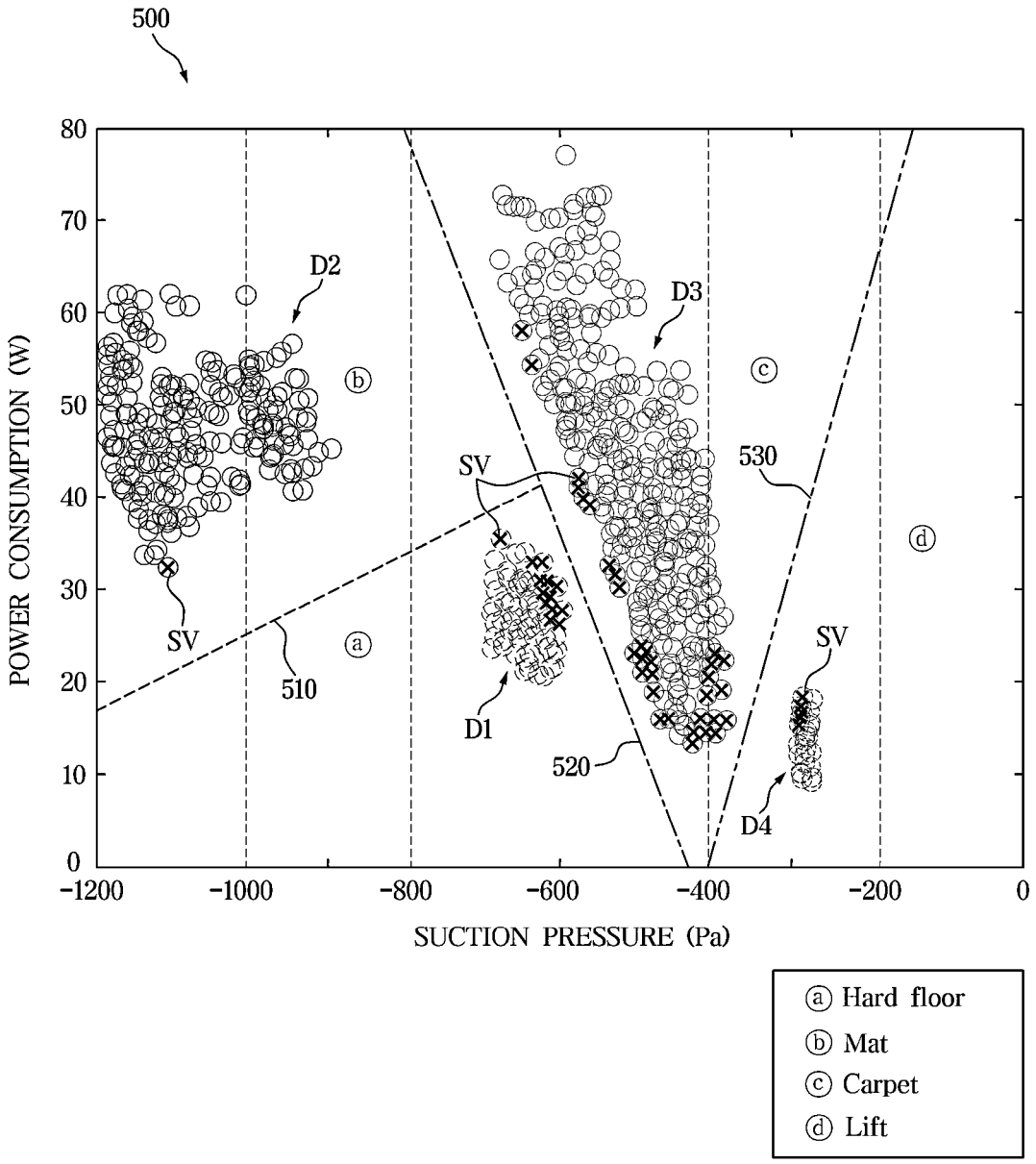
FIG. 5 shows an example of distinguishing types of surfaces to be cleaned using hyperplanes in a two-dimensional coordinate system.

FIG. 5 shows an example of distinguishing types of surfaces to be cleaned using hyperplanes in the two-dimensional coordinate system.

Referring to a graph 500 of FIG. 5, the controller 200 may determine a plurality of hyperplanes using support vectors SV of the reference data stored in the memory 220. For example, the controller 200 may determine a first hyperplane 510, a second hyperplane 520, and a third hyperplane 530. The first hyperplane 510, the second hyperplane 520, and the third hyperplane 530 may be determined by different linear equations. By the first hyperplane 510, the second hyperplane 520, and the third hyperplane 530, the coordinate planes may be classified into a first area ⓐ, a second area ⓑ, a third area ⓒ, and a fourth area ⓓ.

The controller 200 of the vacuum cleaner 1 may identify the type of surface to be cleaned currently being cleaned by identifying where the suction pressure data obtained during the cleaning operation and the data on the load of the brush motor 150 are positioned on the coordinate plane.

A plurality of pieces of driving data including the suction pressure data during the cleaning operation of the vacuum cleaner 1 and the data on the load of the brush motor 150 may be obtained. The plurality of pieces of driving data may correspond to a plurality of points on the coordinate plane. Each of the plurality of points has coordinates. When a variable of the x-axis is the suction pressure and a variable of the y-axis is the load (e.g., power consumption) of the brush motor 150, a plurality of pieces of suction pressure data and a plurality of pieces of data on the load of the brush motor 150 may be expressed as a plurality of points in the two-dimensional coordinate system.

The suction pressure and the load (power consumption) of the brush motor 150 may vary depending on the type of surface to be cleaned that is contacted by the brush 151. For example, the largest absolute value of suction pressure may be measured when the surface to be cleaned is a mat, and the smallest absolute value of suction pressure may be measured when the vacuum cleaner 1 is in a lift state away from the surface to be cleaned. The absolute value of the suction pressure may decrease in the order of the mat, the hard floor, and the carpet, but the change in suction pressure is not limited to this example.

The load (power consumption) of the brush motor 150 may increase as resistance applied to the brush 151 by the surface to be cleaned increases. For example, the load of the brush motor 150 may be measured heavily on a long-haired carpet. The load of the brush motor 150 may decrease in order of the carpet, the mat, and the hard floor, but the change in load is not limited to this example. In the case of the lift state in which the suction head 15 is away from the surface to be cleaned, since the output of the brush motor 150 and the output of the suction motor 160 are adjusted to the smallest, the smallest suction pressure and the smallest load of the brush motor 150 may be measured.

Each of the areas divided by the plurality of hyperplanes may correspond to a different surface to be cleaned. For example, the first area ⓐ may correspond to the hard floor, the second area ⓑ may correspond to the mat, and the third area ⓒ may correspond to the carpet, the fourth area ⓓ may correspond to the lift state. When pieces of first driving data D1 positioned in the first area ⓐ are obtained, the controller 200 may identify the surface to be cleaned as the hard floor. When pieces of second driving data D2 positioned in the second area ⓑ are obtained, the controller 200 may identify the surface to be cleaned as the mat. When pieces of third driving data D3 positioned in the third area ⓒ are obtained, the controller 200 may identify the surface to be cleaned as the carpet. When pieces of fourth driving data D4 positioned in the fourth area ⓓ are obtained, the controller 200 may identify the surface to be cleaned as the lift state.

In other words, the type of surface to be cleaned may be differently identified depending on whether a point corresponding to driving data is positioned above or below the first hyperplane 510, above or below the second hyperplane 520, or above or below the third hyperplane 530. When the suction pressure as an x value and the load of the brush motor 150 as a y value are input to the hyperplane equation determined as a linear equation (e.g., $a*x+b*y+c=0$) in the two-dimensional coordinate system, a positive or negative value may be obtained. When the positive value is obtained, it may be determined that the point corresponding to the driving data is positioned above the hyperplane. When the negative value is obtained, it may be determined that the point corresponding to the driving data is positioned below the hyperplane.

Figure 6:
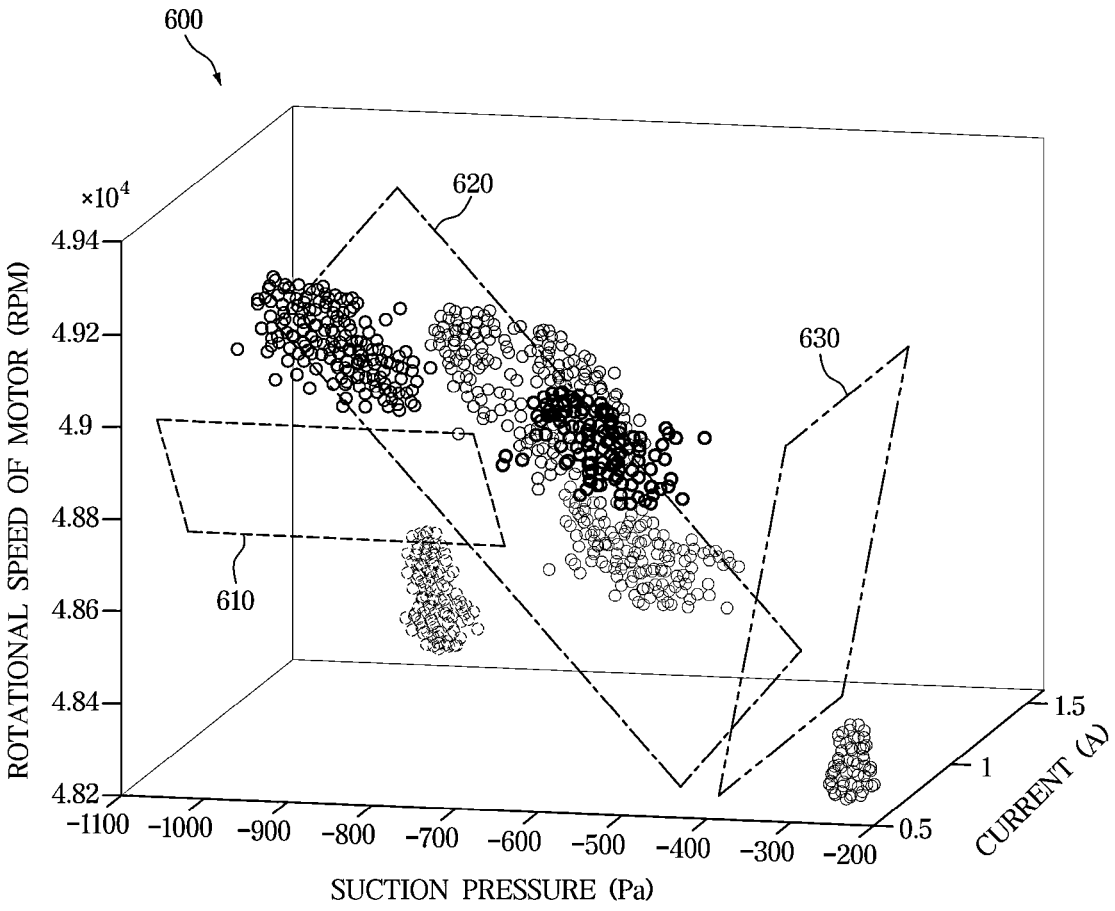
FIG. 6 shows an example of distinguishing types of surfaces to be cleaned using hyperplanes in a three-dimensional coordinate system.

FIG. 6 shows an example of distinguishing types of surfaces to be cleaned using hyperplanes in a three-dimensional coordinate system.

Referring to a graph 600 of FIG. 6, the controller 200 may identify the type of surface to be cleaned based on positions of coordinates corresponding to the suction pressure obtained during the cleaning operation, the load of the brush motor 150, and the rotational speed of the brush motor 150, in the coordinate space including hyperplanes.

The hyperplanes may be determined as planes in the coordinate space. For example, a fourth hyperplane 610, a fifth hyperplane 620, and a sixth hyperplane 630 may be determined. In the three-dimensional coordinate system, when the variable of the x-axis is the suction pressure, the variable of the y-axis is the load of the brush motor 150, and the variable of the z-axis is the rotational speed of the brush motor 150, the plurality of pieces of suction pressure data, the plurality of pieces of data on the load of the brush motor 150, and the plurality of pieces of data on the rotational speed of the brush motor 150 may be expressed as a plurality of points in the three-dimensional coordinate space.

As described above, the suction pressure and the load (power consumption) of the brush motor 150 may vary depending on the type of surface to be cleaned that is contacted by the brush 151. Further, the rotational speed of the brush motor 150 may be detected differently depending on the type of surface to be cleaned. The rotational speed of the brush motor 150 may decrease as resistance applied to the brush 151 by the surface to be cleaned increases. For example, the rotational speed of the brush motor 150 may decrease in the order of the mat, the hard floor, and the carpet, but is not limited to this example. In the case of the lift state in which the suction head 15 is away from the surface to be cleaned, since the output of the brush motor 150 and the output of the suction motor 160 are adjusted to the smallest, the smallest rotational speed of the brush motor 150 may be measured.

The type of surface to be cleaned may be differently identified depending on whether a point corresponding to driving data is positioned above or below the fourth hyperplane 610, above or below the fifth hyperplane 620, or above or below the sixth hyperplane 630. When the suction pressure as an x value, the load of the brush motor 150 as a y value, and the rotational speed of the brush motor 150 as a z value are input to the hyperplane equation determined as a linear equation (e.g., $a*x+b*y+c*z+d=0$) in the three-dimensional coordinate system, a positive or negative value may be obtained. When the positive value is obtained, it may be determined that the point corresponding to the driving data is positioned above the hyperplane. When the negative value is obtained, it may be determined that the point corresponding to the driving data is positioned below the hyperplane. That is, the type of surface to be cleaned may be determined based on a position of the point corresponding to the driving data in the coordinate space. Since a factor for distinguishing the surfaces to be cleaned is added in the three-dimensional coordinate system, the distinguishing of the surfaces to be cleaned may be performed more accurately than in the two-dimensional coordinate system.

FIG. 7 is a table for describing an example in which at least one of the output of the suction motor or the output of the brush motor is adjusted according to the type of surface to be cleaned.

Referring to a table 700 of FIG. 7, the controller 200 of the vacuum cleaner 1 may adjust at least one of the output of the suction motor 160 or the output of the brush motor 150 based on the identified type of surface to be cleaned. For example, when the surface to be cleaned is identified as the hard floor, the output of the suction motor 160 may be adjusted to be the reference output. When the surface to be cleaned is identified as the carpet, the output of the suction motor 160 may be adjusted to be greater than the reference output. When the surface to be cleaned is identified as the mat, the output of the suction motor 160 may be adjusted to be smaller than the reference output. When the suction head 15 is identified as being in the air, that is, in the lift state, the output of the suction motor 160 may be minimized.

In addition, the output of the brush motor 150 may be also adjusted to be the reference output on the hard floor, to be greater than the reference output on the carpet, to be smaller than the reference output on the mat, and to be the minimum output in the lift state.

The adjustment of the output of the brush motor 150 and the adjustment of the output of the suction motor 160 are not limited to these examples. The output of the brush motor 150 and the output of the suction motor 160 may be differently adjusted. In addition, the brush motor 150 and the suction motor 160 may be controlled to operate with different outputs in the illustrated surface to be cleaned.

Figure 8:
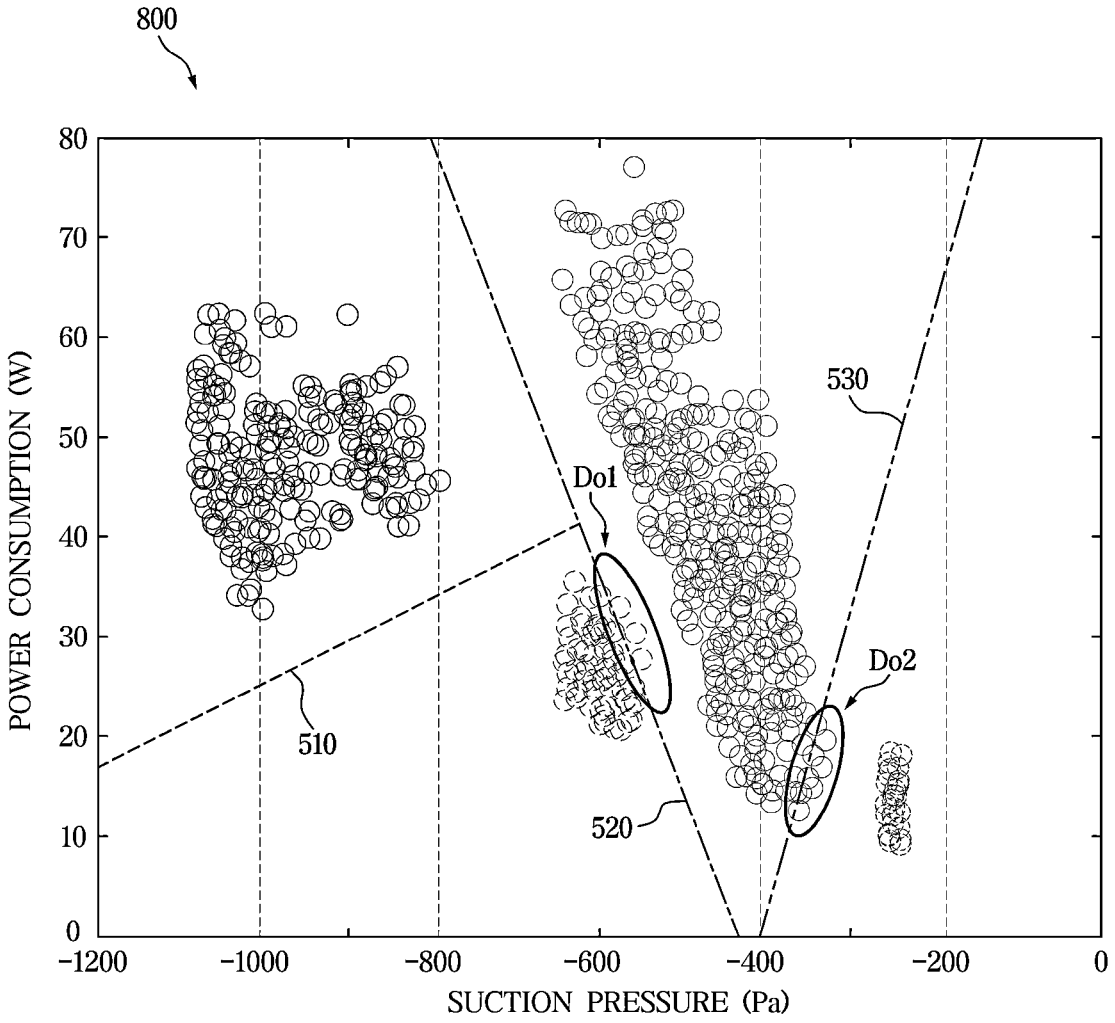
FIG. 8 is a graph for describing an example in which the type of surface to be cleaned is incorrectly identified due to aging of a vacuum cleaner.
Figure 9:
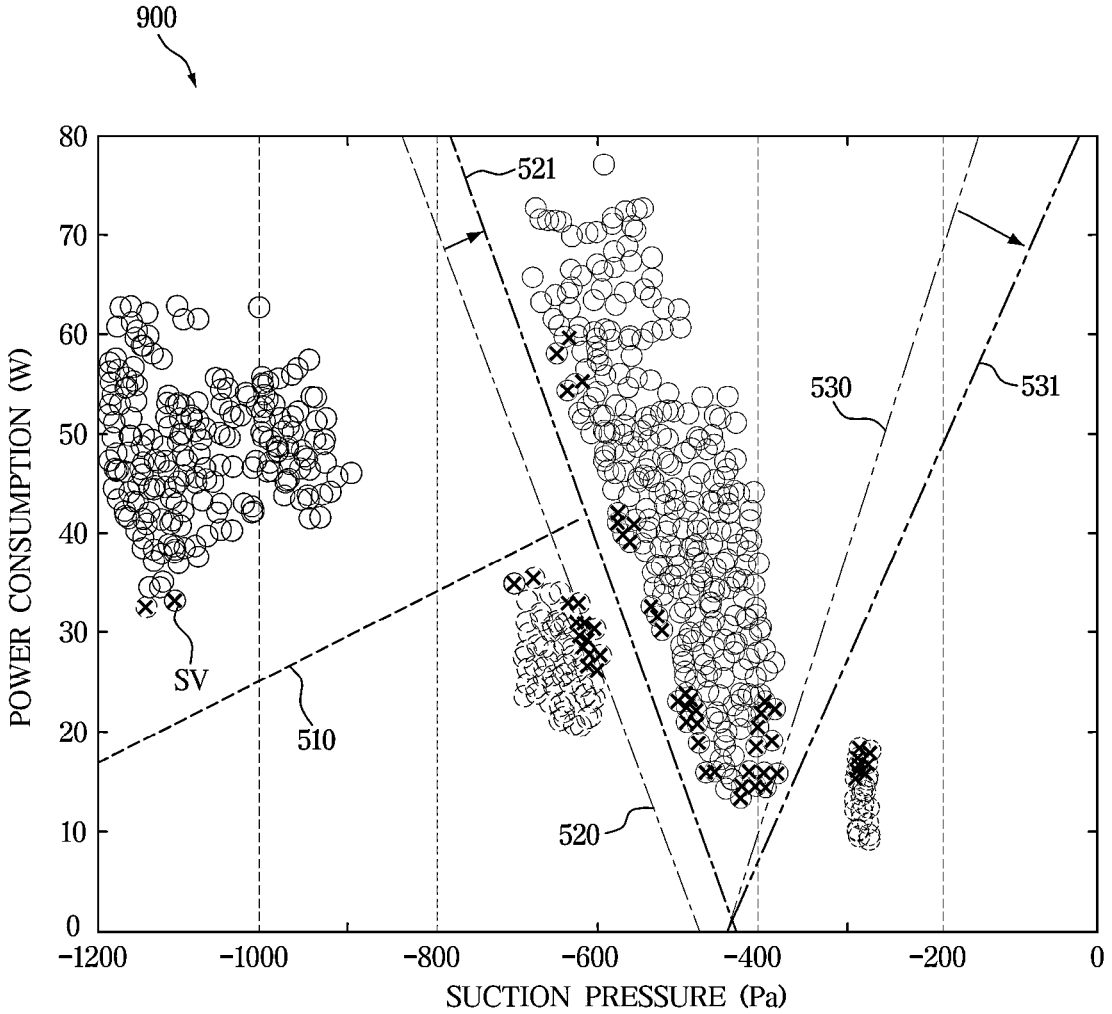
FIG. 9 is a graph illustrating an example in which a hyperplane is changed by updating reference data.

FIG. 8 is a graph for describing an example in which the type of surface to be cleaned is incorrectly identified due to aging of the vacuum cleaner. FIG. 9 is a graph illustrating an example in which a hyperplane is changed by updating hyperplane data.

Referring to a graph 800 of FIG. 8, as the vacuum cleaner 1 ages, a problem in which the type of surface to be cleaned is incorrectly identified may occur. When the reference data stored at the time of manufacture of the vacuum cleaner 1 is used as it is in the aging vacuum cleaner 1, the change in the suction pressure and the change in the load of the brush motor 150 may not be reflected, causing the problem that the type of surface to be cleaned is incorrectly identified.

Due to the aging of the suction motor 160, the suction pressure for a specific surface to be cleaned may be changed. Due to the aging of the brush motor 150, the load of the brush motor 150 for a specific surface to be cleaned may be changed. The rotational speed of the brush motor 150 for a specific surface to be cleaned may also be changed. Due to this, the suction pressure value, the load value and the rotational speed value for the same surface to be cleaned surface may be changed.

For example, a plurality of pieces of driving data obtained while a new vacuum cleaner 1 cleans the hard floor may be positioned between the first hyperplane 510 and the second hyperplane 520. However, as the vacuum cleaner 1 ages, among a plurality of pieces of driving data obtained while the vacuum cleaner 1 is cleaning the hard floor, some pieces of driving data crossing the second hyperplane 520 may be included. Some pieces of driving data crossing the second hyperplane 520 may be referred to as first interference data Do1. Since the first interference data Do1 is positioned between the second hyperplane 520 and the third hyperplane 530, even though the surface to be cleaned that the vacuum cleaner 1 is actually cleaning is the hard floor, the controller 200 may temporarily misidentify the surface to be cleaned as the carpet.

Among the plurality of pieces of driving data obtained while the vacuum cleaner 1 is cleaning the carpet, second interference data Do2 crossing the third hyperplane 530 may be included. Due to the second interference data Do2, the controller 200 may temporarily misidentify that the vacuum cleaner 1 is in the lift state, even though the surface to be cleaned that the vacuum cleaner 1 is actually cleaning is the carpet. In this case, the erroneous identification may cause consumers to misunderstand product failure, and may adversely affect the cleaning performance and the battery performance. The disclosed vacuum cleaner 1 is able to solve the problems by updating the reference data in consideration of aging.

Referring to a graph 900 of FIG. 9, the controller 200 of the vacuum cleaner 1 may change the hyperplane by updating reference data for determining the hyperplane. By updating the reference data, the existing second hyperplane 520 may be changed to a new second hyperplane 521, and the existing third hyperplane 530 may be changed to a new third hyperplane 531. The first hyperplane 510 may remain unchanged. Through the change of the hyperplane, even though the suction pressure and the load of the brush motor 150 for the same surface to be cleaned are changed, the type of surface to be cleaned may be correctly identified.

The new second hyperplane 521 and the new third hyperplane 531 may be obtained from existing support vectors and driving data obtained during the cleaning operation. The controller 200 may extract a new support vector from the support vector already stored in the memory 220 and the driving data obtained during the cleaning operation. A plurality of new support vectors may be extracted. The controller 200 may determine a new hyperplane equation based on the plurality of new support vectors. The aging of the vacuum cleaner 1 may be reflected more accurately by reflecting the existing reference data in determining the new hyperplane. The new support vector and the new hyperplane equation may be stored in the memory 220 as new reference data. In addition, the existing support vectors and the existing hyperplane equation may be deleted.

FIG. 10 is a table for describing examples of update conditions for executing update of the hyperplane data.

Referring to a table 1000 of FIG. 10, the vacuum cleaner 1 may update the reference data when any one of five update conditions illustrated in the table 1000 is met.

1) The vacuum cleaner 1 may update the reference data when a predetermined update cycle is reached. The update cycle may vary depending on a design. For example, the update cycle may be determined according to a capacity of the memory 220. When the capacity of the memory 220 is relatively small, since it is not possible to store a lot of data, the update cycle may be set to be relatively short. When the performance of the processor 210 is low, since it is difficult to process a lot of data, the update cycle may be set to be relatively short.

2) The vacuum cleaner 1 may update the reference data when the cumulative cleaning time is greater than or equal to the critical cleaning time. When the cumulative cleaning time of the vacuum cleaner 1 reaches the critical cleaning time, the reference data may be updated to correct the hyperplane. The critical cleaning time may be determined in consideration of the performance of the battery 60, the performance of the brush motor 150, and the performance of the suction motor 160.

3) The vacuum cleaner 1 may update the reference data when the difference between the first suction pressure calculated in the lift state during the previous diagnosis and the second suction pressure calculated in the lift state during the current diagnosis is greater than or equal to the predetermined first threshold value. When the vacuum cleaner 1 enters the diagnosis mode, the controller 200 may detect the suction pressure in the lift state. When the change in the suction pressure detected in the lift state is greater than or equal to a certain level, it may be determined that the performance of the suction motor 160 is significantly changed. Accordingly, it may be determined that hyperplane correction is required, and the reference data may be updated.

4) The vacuum cleaner 1 may update the reference data when the difference between the first load of the brush motor 150 detected in the lift state during the previous diagnosis and the second load of the brush motor 150 detected in the lift state during the current diagnosis is greater than or equal to the predetermined second threshold value. When the vacuum cleaner 1 enters the diagnosis mode, the controller 200 may detect the load of the brush motor 150 in the lift state. When the change in the load of the brush motor 150 detected in the lift state is greater than or equal to a certain level, it may be determined that the performance of the brush motor 150 is significantly changed. Accordingly, it may be determined that hyperplane correction is required, and the reference data may be updated.

The vacuum cleaner 1 may update the reference data when the distance from coordinates corresponding to the driving data obtained during the cleaning operation to the hyperplane is less than or equal to the predetermined threshold distance. The closer the distance between the hyperplane and the point corresponding to the driving data on the coordinate plane or in coordinate space becomes, the higher the probability that an error occurs in identifying the type of surface to be cleaned. Therefore, when the distance between the point corresponding to the driving data and the hyperplane is smaller than or equal to the threshold distance, it is preferable to correct the hyperplane by updating the reference data.

Figure 11:
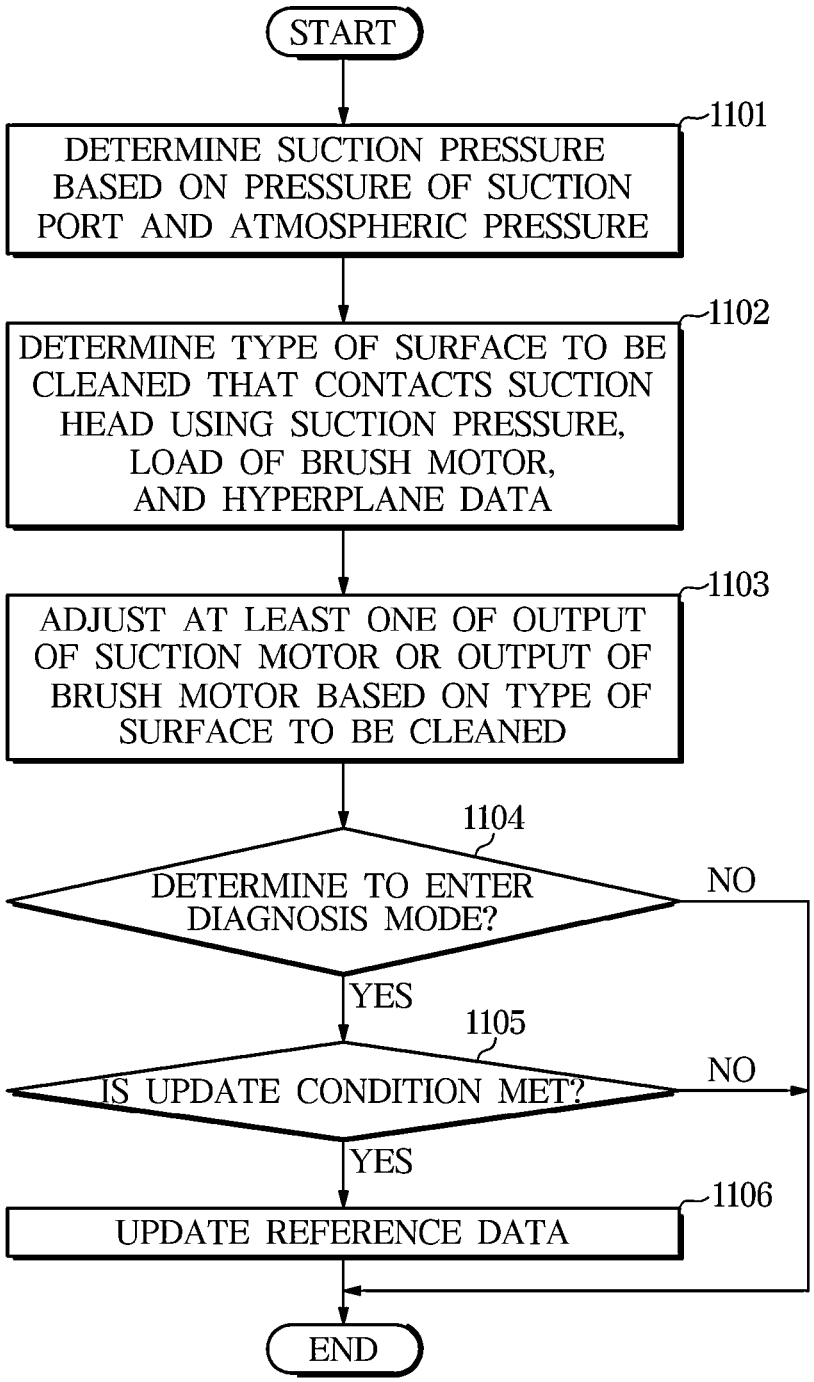
FIG. 11 is a flowchart illustrating a control method for a vacuum cleaner in accordance with one exemplary embodiment.

FIG. 11 is a flowchart illustrating a control method for the vacuum cleaner in accordance with one exemplary embodiment.

Referring to FIG. 11, the controller 200 of the vacuum cleaner 1 may detect a pressure of the suction port 15*a* included in the suction head 15 in response to the operation of the suction motor 160, and may determine a suction pressure based on the atmospheric pressure and the pressure of the suction port 15*a* (1101). Further, the controller 200 may determine a load of the brush motor 150 rotating the brush 151 provided inside the suction head 15. The load of the brush motor 150 may be determined by current applied to the brush motor 150 or power consumption of the brush motor 150. The controller 200 may also detect a rotational speed of the brush motor 150.

The controller 200 may obtain reference data used to identify the type of surface to be cleaned from the memory 220, and may determine the type of surface to be cleaned that contacts the suction head 15 using the suction pressure, the load of the brush motor 150, and the reference data (1102). The rotational speed of the brush motor 150 may also be considered to determine the type of surface to be cleaned.

The reference data may include a hyperplane equation serving as a criterion for distinguishing the type of surface to be cleaned in the two-dimensional coordinate system or the three-dimensional coordinate system and a support vector used to determine the hyperplane equation. A hyperplane according to the hyperplane equation may be a criterion for determining the type of surface to be cleaned. For example, a plurality of pieces of suction pressure data obtained during the cleaning operation and a plurality of pieces of data on the load of the brush motor 150 may be expressed as a plurality of points in the two-dimensional coordinate system. The type of surface to be cleaned may be determined according to positions of the plurality of points on the coordinate plane including the hyperplane.

The controller 200 may adjust at least one of the output of the suction motor 160 or the output of the brush motor 150 based on the determined type of surface to be cleaned (1103). The vacuum cleaner 1 may increase the use time of the battery and improve the cleaning performance by adjusting at least one of the output of the brush motor 150 or the output of the suction motor 160 according to the type of surface to be cleaned.

The controller 200 may determine whether to enter the diagnosis mode (1104). The controller 200 may enter a diagnosis mode based on whether the main body 10 of the vacuum cleaner 1 is mounted on a charging station or a diagnosis execution command is received through the user interface 180. In response to stopping the operations of the suction motor 160 and the brush motor 150 and entering the diagnosis mode, the controller 200 may check the update conditions of the reference data (1105). The controller 200 may update the reference data used to identify the type of surface to be cleaned based on whether a predetermined update condition is met (1106).

Figure 12:
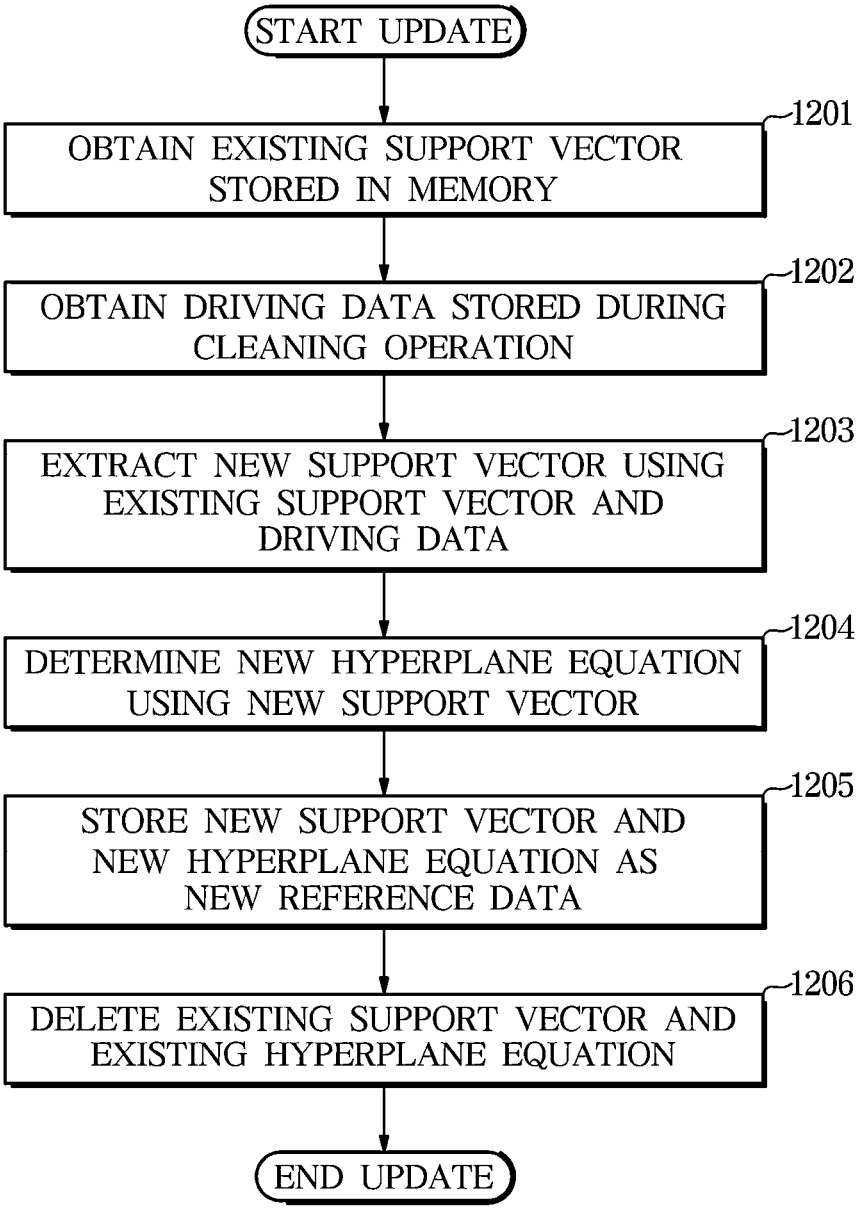
FIG. 12 is a flowchart illustrating in detail a method of updating reference data described in FIG. 11.

FIG. 12 is a flowchart illustrating in detail a method of updating the hyperplane described in FIG. 11.

Referring to FIG. 12, the controller 200 may obtain a support vector of the reference data and driving data stored during the cleaning operation in response to the start of updating (1201 and 1202). The driving data may include suction pressure data and data for on load of the brush motor 150. The driving data may further include data on the rotational speed of the brush motor 150.

The controller 200 may extract a new support vector based on the existing support vector and the driving data (1203), and may determine a new hyperplane equation based on the new support vector (1204). A plurality of new support vectors may be extracted. A closest hyperplane may be determined from the plurality of new support vectors. Coefficients and constants of the new hyperplane equation may be determined as different values from coefficients and constants of the existing hyperplane equation.

The controller 200 may determine the new hyperplane equation as a linear equation in the two-dimensional coordinate system in which the suction pressure and the load of the brush motor 150 are variables of the coordinate axes. In addition, the controller 200 may determine the new hyperplane equation as a linear equation in the three-dimensional coordinate system in which the suction pressure, the load of the brush motor 150, and the rotational speed of the brush motor 150 are variables of the coordinate axes.

The controller 200 may store the new support vector and the new hyperplane equation in the memory 220 as new reference data (1205). The new reference data may be used in a cleaning operation to be performed later. The controller 200 may delete the existing support vector and the existing hyperplane equation (1206).

The disclosed vacuum cleaner and control method for the same may update criteria for classifying types of surfaces to be cleaned in consideration of aging of the vacuum cleaner. In this way, a problem in which the type of surface to be cleaned is incorrectly identified due to the aging of the vacuum cleaner may be prevented.

The disclosed vacuum cleaner and control method for the same may improve user convenience by preventing erroneous determination for the surface to be cleaned, and may reduce deterioration in cleaning performance and battery performance.

Meanwhile, the disclosed exemplary embodiments may be implemented in the form of a storage medium storing instructions executable by a computer. Instructions may be stored in the form of program codes, and when executed by a processor, may create program modules to perform operations of the disclosed exemplary embodiments.

A machine-readable storage medium may be provided in the form of a non-transitory storage medium. Here, the term "non-transitory storage medium" simply means that the storage medium is a tangible device, and does not include a signal (e.g., an electromagnetic wave), but this term does not differentiate between a case where data is semi-permanently stored in the storage medium and a case where the data is temporarily stored in the storage medium. For example, the "non-transitory storage medium" may include a buffer in which data is temporarily stored.

A method according to various exemplary embodiments disclosed herein may be included and provided in a computer program product. The computer program product may be traded as a product between a seller and a buyer. The computer program product may be distributed in the form of a machine-readable storage medium (e.g., a compact disc read only memory (CD-ROM)), or be distributed (e.g., downloaded or uploaded) online through an application store (e.g., PlayStore™), or between two user devices (e.g., smartphones) directly. When distributed online, at least part of the computer program product (e.g., a downloadable app) may be temporarily generated or at least temporarily stored in the machine-readable storage medium, such as memory of the manufacturer's server, a server of the application store, or a relay server.

As is apparent from the above description, a vacuum cleaner and a control method for the same in accordance with one exemplary embodiment of the present disclosure can update criteria for classifying types of surfaces to be cleaned in consideration of aging of the vacuum cleaner. In this way, a problem in which the type of surface to be cleaned is incorrectly identified due to the aging of the vacuum cleaner can be prevented.

The vacuum cleaner and the control method for the same in accordance with one exemplary embodiment of the present disclosure can improve user convenience by preventing erroneous determination for the surface to be cleaned, and can reduce deterioration in cleaning performance and battery performance.

As described above, the disclosed exemplary embodiments have been described with reference to the accompanying drawings. It will be understood by those skilled in the art that various changes in form and details may be made therein without departing from the spirit and scope of the present disclosure as defined by the appended claims and their equivalents. The disclosed exemplary embodiments are illustrative and should not be construed as limiting.

What is claimed is:

1. A vacuum cleaner comprising:

a main body;

a suction motor in the main body, the suction motor configured to generate a suction force to suck foreign substances;

an extension pipe;

a suction head connected to the suction motor through the extension pipe, the suction head including a suction port through which the foreign substances are sucked;

a brush configured to be rotated inside the suction head;

a brush motor configured to rotate the brush;

a pressure sensor configured to detect a pressure of air flowing through the suction port;

a memory configured to store reference data used to identify a type of surface to be cleaned and a learning model to update the stored reference data; and a controller configured to:

determine a suction pressure based on the detected pressure and an atmospheric pressure;

identify the type of surface to be cleaned that is to be contacted by the suction head using the determined suction pressure, a load of the brush motor, and the stored reference data;

adjust at least one of an output of the suction motor and an output of the brush motor based on the identified type of surface to be cleaned;

store suction pressure data and data on the load of the brush motor as driving data in the memory during a cleaning operation of the vacuum cleaner;

determine an update of the stored reference data based on a predetermined update condition;

obtain new reference data by inputting the driving data and the reference data into the learning model based on determining the update of the reference data; and update the reference data by storing the new reference data in the memory.

2. The vacuum cleaner according to claim 1, wherein:

the reference data includes a hyperplane equation serving as a criterion to distinguish the type of surface to be cleaned in a two-dimensional coordinate system or a three-dimensional coordinate system, and a support vector used to determine the hyperplane equation; and the controller is further configured to:

extract a new support vector based on the obtained driving data and the support vector;

determine a new hyperplane equation based on the extracted new support vector; and store the extracted new support vector and the determined new hyperplane equation as the new reference data.

3. The vacuum cleaner according to claim 2, wherein the controller is further configured to determine the new hyperplane equation as a linear equation in the two-dimensional coordinate system in which the determined suction pressure and the load of the brush motor are variables of coordinate axes.

4. The vacuum cleaner according to claim 2, wherein:

the driving data further includes data on a rotational speed of the brush motor; and the controller is further configured to determine the new hyperplane equation as a linear equation in the three-dimensional coordinate system in which the suction pressure, the load of the brush motor, and the rotational speed of the brush motor are variables of coordinate axes.

5. The vacuum cleaner according to claim 1, wherein the controller is further configured to update the stored reference data according to the predetermined update condition in response to stopping operations of the suction motor and the brush motor and entering a diagnosis mode.

6. The vacuum cleaner according to claim 5, wherein the controller is further configured to update the stored reference data, in response to reaching a predetermined update cycle, in response to determining that a cumulative cleaning time is greater than or equal to a critical cleaning time, in response to determining that a difference between a first suction pressure calculated in a lift state during a previous diagnosis and a second suction pressure calculated in the lift state during a current diagnosis, is greater than or equal to a predetermined first threshold value, in response to determining that a difference between a first load of the brush motor detected in the lift state during the previous diagnosis and a second load of the brush motor detected in the lift state during the current diagnosis, is greater than or equal to a predetermined second threshold value, or in response to determining that a distance from coordinates corresponding to the driving data obtained during the cleaning operation to a hyperplane, is less than or equal to a predetermined threshold distance.

7. The vacuum cleaner according to claim 5, further comprising a user interface configured to obtain a user input, wherein the controller is further configured to enter the diagnosis mode based on whether the main body is mounted on a charging station or a diagnosis execution command is received through the user interface.

8. The vacuum cleaner according to claim 1, wherein the controller is further configured to determine the load of the brush motor based on current applied to the brush motor or power consumption of the brush motor.

9. A vacuum cleaner comprising:

a main body;

a suction motor in the main body, the suction motor configured to generate a suction force to suck foreign substances;

an extension pipe;

a suction head connected to the suction motor through the extension pipe, the suction head including a suction port through which the foreign substances are sucked;

a brush configured to be rotated inside the suction head;

a brush motor configured to rotate the brush;

a pressure sensor configured to detect a pressure of air flowing through the suction port;

a memory configured to store reference data used to identify a type of surface to be cleaned and a learning model to update the stored reference data; and a controller configured to:

determine a suction pressure based on the detected pressure, an atmospheric pressure, and a load of the brush motor;

identify the type of surface to be cleaned based on positions of coordinates corresponding to the determined suction pressure and the load of the brush motor in a coordinate plane including a hyperplane determined by the stored reference data;

adjust at least one of an output of the suction motor and an output of the brush motor based on the identified type of surface to be cleaned; and update the stored reference data based on a predetermined update condition.

10. A control method for a vacuum cleaner, comprising a main body, a suction motor in the main body, an extension pipe, a suction head connected to the suction motor through the extension pipe, a brush configured to be rotated inside the suction head, a brush motor, a pressure sensor, a memory configured to store reference data used to identify a type of surface to be cleaned and a learning model to update the stored reference data, and a controller: the control method comprising:

detecting a pressure of air, by a pressure sensor, flowing through a suction port of the suction head of the vacuum cleaner in response to an operation of the suction motor;

determining a suction pressure, by the controller, based on the detected pressure of the suction port and an atmospheric pressure;

determining a load of the brush motor configured to rotate a brush inside the suction head;

obtaining reference data, used to identify a type of surface to be cleaned, from a memory of the vacuum cleaner;

identifying the type of surface to be cleaned that is to be contacted by the suction head using the determined suction pressure, the load of the brush motor, and the obtained reference data;

adjusting at least one of an output of the suction motor and an output of the brush motor based on the identified type of surface to be cleaned;

storing suction pressure data and data on the load of the brush motor as driving data in the memory during a cleaning operation of the vacuum cleaner;

determining an update of the reference data stored in the memory based on a predetermined update conditions;

obtaining new reference data by inputting the driving data and the reference data into the learning model based on determining the update of the reference data; and updating the reference data by storing the new reference data in the memory.

11. The control method according to claim 10, wherein:

the reference data includes a hyperplane equation serving as a criterion distinguish the type of surface to be cleaned in a two-dimensional coordinate system or a three-dimensional coordinate system and a support vector used to determine the hyperplane equation; and the obtaining of the new reference data includes:

extracting a new support vector based on the support vector and the obtained driving data;

determining a new hyperplane equation based on the extracted new support vector; and storing the extracted new support vector and the determined new hyperplane equation as the new reference data.

12. The control method according to claim 11, wherein the new hyperplane equation is determined as a linear equation in the two-dimensional coordinate system in which the suction pressure and the load of the brush motor are variables of coordinate axes.

13. The control method according to claim 11, wherein:

the driving data further includes data on a rotational speed of the brush motor; and the new hyperplane equation is determined as a linear equation in the three-dimensional coordinate system in which the determined suction pressure, the load of the brush motor, and the rotational speed of the brush motor are variables of coordinate axes.

14. The control method according to claim 10, wherein the updating of the stored reference data is performed according to the predetermined update condition in response to stopping operations of the suction motor and the brush motor and entering a diagnosis mode.

15. The control method according to claim 14, wherein the updating of the stored reference data is performed, in response to reaching a predetermined update cycle, in response to determining that a cumulative cleaning time is greater than or equal to a critical cleaning time, in response to determining that a difference between a first suction pressure calculated in a lift state during a previous diagnosis and a second suction pressure calculated in the lift state during a current diagnosis, is greater than or equal to a predetermined first threshold value, in response to determining that a difference between a first load of the brush motor detected in the lift state during the previous diagnosis and a second load of the brush motor detected in the lift state during the current diagnosis, is greater than or equal to a predetermined second threshold value, or in response to determining that a distance from coordinates corresponding to the driving data obtained during the cleaning operation to a hyperplane, is less than or equal to a predetermined threshold distance.

16. The control method according to claim 14, wherein the entering of the diagnosis mode is performed based on whether the main body is mounted on a charging station or a diagnosis execution command is received through a user interface.

17. The control method according to claim 10, wherein the load of the brush motor is determined based on current applied to the brush motor or power consumption of the brush motor.

18. A control method for a vacuum cleaner comprising a main body, a suction motor in the main body, an extension pipe, a suction head connected to the suction motor through the extension pipe, a brush configured to be rotated inside the suction head, a brush motor, a pressure sensor, a memory configured to store reference data used to identify a type of surface to be cleaned and a learning model to update the stored reference data; and a controller, the control method comprising:

detecting a pressure of air, by a pressure sensor, flowing through a suction port of the suction head of the vacuum cleaner in response to an operation of the suction motor;

determining a suction pressure, by the controller, based on the detected pressure of the suction port and an atmospheric pressure;

determining a load of the brush motor configured to rotate a brush inside the suction head;

obtaining the reference data from the memory;

the identifying of the type of surface to be cleaned based on positions of coordinates corresponding to the determined suction pressure and the load of the brush motor in a coordinate plane including a hyperplane determined by the reference data;

adjusting at least one of an output of the suction motor and an output of the brush motor based on the identified type of surface to be cleaned; and updating the reference data stored in the memory based on a predetermined update condition.

* * * * *